US007074141B2

(12) United States Patent
Bryant, Jr. et al.

(10) Patent No.: US 7,074,141 B2
(45) Date of Patent: Jul. 11, 2006

(54) ADJUSTABLE AND PORTABLE SOCCER GOAL AND MOLDED JOINT CONNECTORS ASSOCIATED THEREWITH

(76) Inventors: Olen W. Bryant, Jr., 5580 Long Walk Dr., Kernersville, NC (US) 27284; Todd W. Bryant, 131 Hickory Creek Ct., Winston-Salem, NC (US) 27107

( * ) Notice: Subject to any disclaimer, the term of this patent is extended or adjusted under 35 U.S.C. 154(b) by 0 days.

(21) Appl. No.: 10/655,115

(22) Filed: Sep. 4, 2003

(65) Prior Publication Data

US 2005/0054464 A1 Mar. 10, 2005

(51) Int. Cl.
*A63B 63/00* (2006.01)

(52) U.S. Cl. ..... 473/478; 403/297

(58) Field of Classification Search ..... 473/478, 473/476, 415; 403/106, 234, 260, 297, 7, 403/8, 91, 403, 382, 231, 233, 174
See application file for complete search history.

(56) References Cited

U.S. PATENT DOCUMENTS

| | | | | |
|---|---|---|---|---|
| 3,424,178 | A * | 1/1969 | Yazaki | 135/157 |
| 4,921,257 | A * | 5/1990 | Heller | 473/446 |
| 5,080,375 | A * | 1/1992 | Moosavi | 473/478 |
| 5,865,693 | A * | 2/1999 | Johnson | 473/478 |

* cited by examiner

*Primary Examiner*—Sebastiano Passaniti
*Assistant Examiner*—M. Chambers

(57) ABSTRACT

An adjustable and portable soccer goal formed from tubular members in a horizontal, vertical and rearward slanting configuration. Segments of the members are used to form the members in varying sizes by adding or taking away segments vertically, horizontally and inclining to achieve desired lengths. The segments are joined together by molded joint connectors extending in most cases to the ends of two segments being joined together and as a cap or insert in other situations when more than two segments are joined at the same location. The soccer goal can be totally disassembled for removal and repositioning with various formed members being disconnected by the use of an efficiently designed connect/disconnect tool.

4 Claims, 16 Drawing Sheets

Fig. 13A
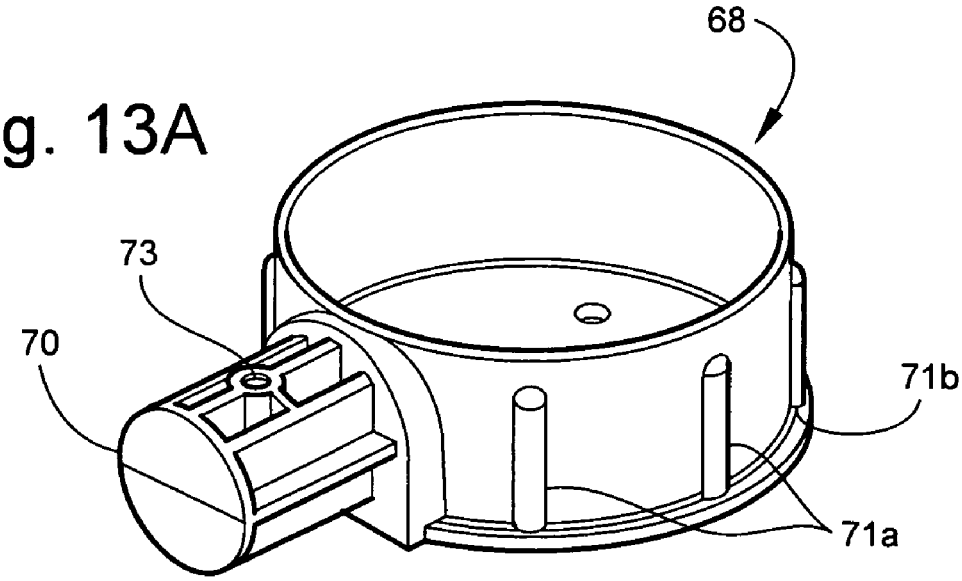
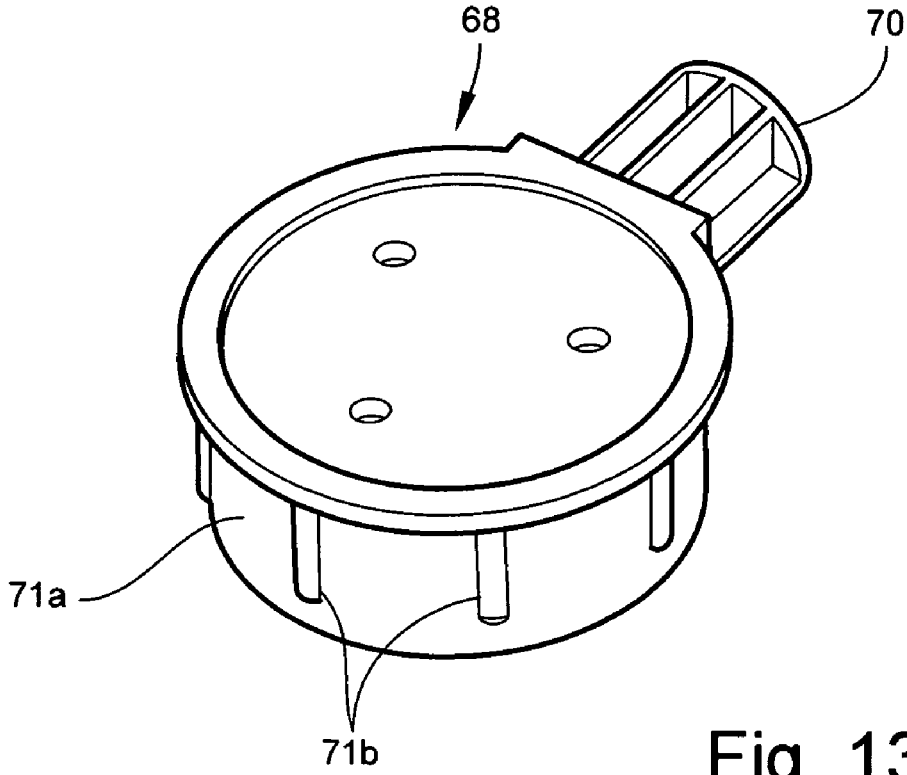
Fig. 13B

ADJUSTABLE AND PORTABLE SOCCER GOAL AND MOLDED JOINT CONNECTORS ASSOCIATED THEREWITH

BACKGROUND OF THE INVENTION

1. Field of the Invention

The present invention relates to portable framework structures and, more particularly, to such structures that are used with a net to construct a goal for use in various sporting events. More specifically, the present invention relates to a portable soccer goal the frame of which is constructed of vertical, horizontal and inclined bracing members joined in the preferred configuration by a plurality of variously configured molded joint connectors.

2. Description of the Prior Art

Outside the United States, soccer has long been the world's most popular sport. Inside the United States, the sport was virtually ignored throughout the 1960's and 70's. Beginning with the youth program in the 1980's, the popularity of soccer has dramatically increased achieving nationwide recognition in 1994 when the World Cup events were held in the United States.

Today soccer is in rapid pursuit of baseball as "a national pastime." Its popularity has continued grow and has passed softball and touch football. According to statistics gathered by the Soccer Industry Council of America, soccer's popularity cuts across demographic and geographic lines. Females account for over half of the players, and California and New York, followed by Texas, Pennsylvania and Ohio have the greatest percentage of children participating in the sport. Children of ages from 7 through 11 represent the single largest number of soccer players accounting for approximately 43% of the nation's players. The participants in the 7 through 17 age group represent over 70% of the nation's soccer players.

The rising popularity of the sport has resulted in the establishment of increasing numbers of recreational and competitive soccer teams. With the sport being taken more seriously, semi-professional coaches have been hired and practice regimens are scheduled. Fortunately, the required equipment for practicing is minimal in comparison with some other sports, with a soccer ball and a rectangular field area all that is necessary to participate. To hone soccer skills, a simulation of the goal area is needed to sharpen both goal-tending skills and goal-scoring ability. It is important that all three dimensions-height, width and depth of an official goal—be available during at least part of the practice sessions.

Because schools are in large part responsible for the awakening of children's heightened interest in soccer, school grounds are frequently the location of soccer practicing. Because the majority of schools are unable to provide great numbers of permanent soccer fields, most soccer teams and players must rely on portable soccer goals if such active practice sessions are to be provided on a regular basis.

Regulation soccer goals measure 24 feet by 8 feet, and providing such a large netted structure in a portable design has proven to be somewhat difficult. One solution has been to utilize basically the same components as in a permanent soccer goal with attachment to a wheeled foundation provided in the place of ground foundation structures. Such a goal is quite heavy and presents safety concerns to those around it.

One alternate solution has been the construction of soccer nets on site using a multiple component framework to which separate netting is attached. Once assembled, the framework design tended to simulate the more permanent soccer net structures by including a number of heavy, oversize components that were of marginal portability. By separating the net from the outer framework, the opportunities for inadvertent separation of the two components increased.

In addition to being of questionable portability, the semi-permanent wheeled nets and the use of heavy multi-component frames also present a safety risk when improperly installed or when used in a manner for which they were not designed. Such non-soccer activities have included using the structures for climbing or performing aerobatics which sometimes results in severe, even fatal, injuries. In one case, as one person climbed on the horizontal header of a 600 lb. steel goal post, the goal post tipped forward struck the head of a another person who was hanging from the header resulting in fatal injuries. At the time of the incident, this goal post was not properly anchored to the ground. In another case, a boy in California suffered severe and permanent trauma to the head when he was knocked unconscious by a falling soccer goal. This player was moving the goal into place with his teammates at the time of the injury.

The Consumer Product Safety Commission (CPSC) indicates that there are 12 million soccer players in the United States under the age of 18 who play soccer at least once a year. It also estimates that there are approximately 225,000 to 500,000 soccer goals in this country. Many of these are unsafe because they are not stable or are not properly weighted or anchored.

Injuries relating to soccer goals fall into the following categories most of which relate to portable goals. They include (a) goals falling onto people when they are moving the goal from one location to another, (b) people falling from goals while climbing or hanging from goals or nets, (c) goals falling on people who are pulling down or pulling on crossbars, (d) injuries or fatalities occurring as a result of running into goal posts, (e) goals falling over as a result of high winds or wind gusts and (f) cuts/abrasions resulting from sharp edges or jagged metal or wood pieces protruding from goal posts.

The CPSC reports that at least 21 deaths during the period 1979–1994 were associated with movable soccer goals. The mean age of the 21 subjects was ten years of age. Three additional fatalities involving children were documented from January 1993 through July 1994 by falling goal posts bringing the number of reported deaths to 24. In addition, an estimated 120 injuries involving falling goal posts were treated each year in U.S. hospital emergency rooms during the period 1989 through 1993. The CPSC has since recommended that goal posts not in use should be either chained to a fence or other permanent structure, placed goal-faced-down on the ground or disassembled for storage.

Because large number of children start playing soccer at a very young age, they improve significantly as they grow older. When at the earliest age, the children are small, and the soccer nets can be made in smaller sizes and placed on smaller than normal playing fields. As the children grow in age, size and skills, soccer goals and fields can be gradually increased in size. Thus there is a need for an improved soccer goal that is portable, adjustable in size and safely constructed and anchored, and it is to this need that the present invention is directed.

OBJECTIVES AND SUMMARY OF THE INVENTION

A principle objective the present invention is to provide a sporting goal that can be easily setup and dismantled and that can be increased or reduced in size for ease and portability and enhancement of skills.

A further objective of the present invention is to eliminate the use of large and potentially harmful clips and fasteners to attach the netting to framework.

Yet another objective of the present invention is to construct the frame of the goal of multiple members of hollow tubing that can be securely joined together by newly developed molded joint connectors.

Yet another objective of the present invention is to utilize hollow tubular members of designed lengths to size the goal for smaller players and to expand the same goal to a larger regulation size for more skilled and experienced players.

Still another objective of the present invention is to provide as a primary goal the production of a new adjustable and portable soccer goal that reduces to the extent possible the risks of placing soccer goals in soccer-interested communities throughout the world that may lead to injuries to soccer players, soccer player support staffs, fans and all other interested parties.

An adjustable and portable soccer goal is provided with at least a top horizontal member connecting two vertical side supports, at least two rearwardly inclined bracing members formed in a circular configuration, one bracing member engaging the top and bottom of one vertical member. The two bracing members are connected by a lower horizontal member to provide stability for the goal.

The goal is constructed of hollow members with the vertical side supports and the horizontal member connecting them having a preferred thickness or diameter of approximately four inches. The bracing members and the lower horizontal member preferably have a smaller thickness or diameter of approximately 1½ inches.

The goal frame can be sized in height and width by using shorter or longer four inch vertical side supports and a shorter or longer top horizontal member connecting them. The smaller members are used to form the bracing members and the lower horizontal post. It has been found advantageous to provide curved segments both near the bottom and near the top of the vertical side supports when forming the bracing members.

All member connections are made with specifically designed molded joint connectors for joining sections of the same thickness or diameter in an end-to-end relationship, for connecting two members in a T-shaped configuration and for connecting three members at a same location. Member segments when connected with the particular molded joint connector needed are secured to the connector preferably by Allen screws going through the member wall and into molded apertures formed in the connector.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

BRIEF DESCRIPTION OF THE DRAWINGS

FIG. 6C is another perspective view of the assembled soccer goal frame utilizing extensions in the vertical side supports, the top horizontal member and the horizontal ground member;

FIG. 13A is a top perspective view of the connector used to join the horizontal ground member to the bracing member lower end as shown in FIGS. 1A and 5;

FIG. 13B is a bottom perspective view of the connector shown in FIGS. 1A, 5 and 13A;

DETAILED DESCRIPTION OF THE PREFERRED EMBODIMENT

Figure 1:
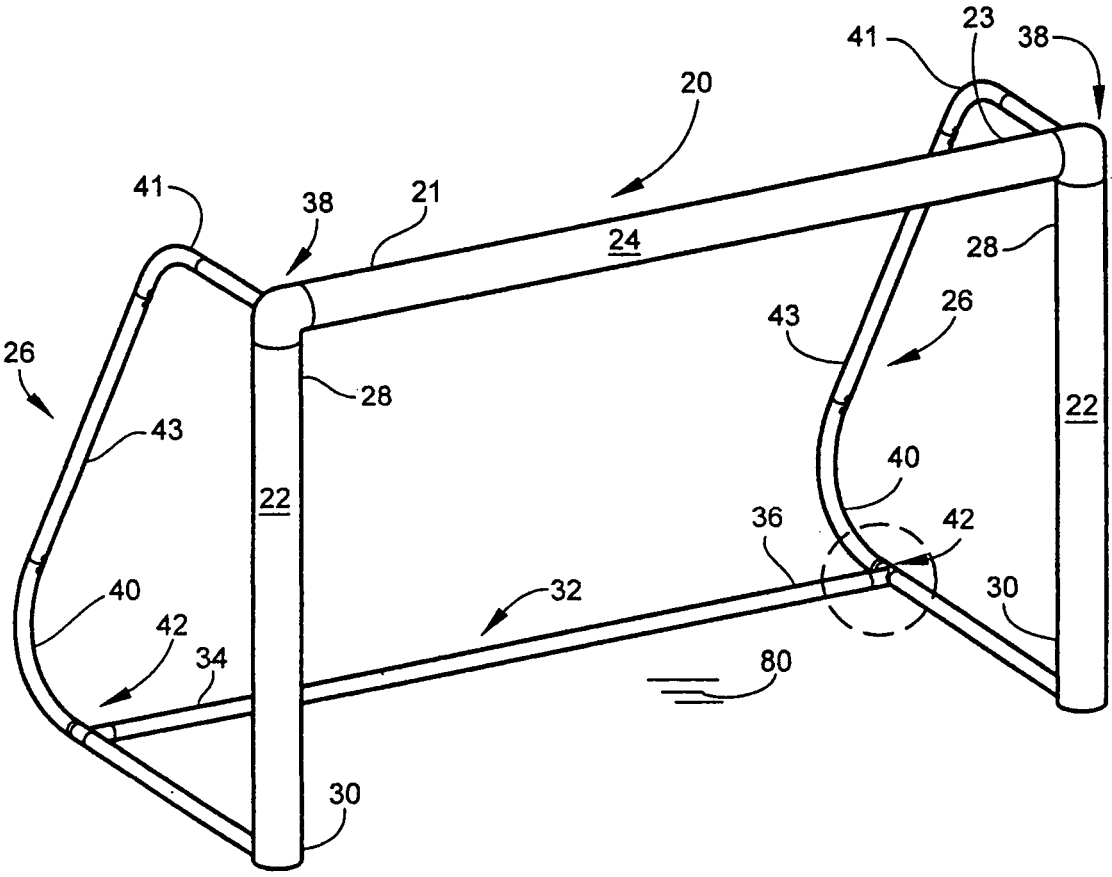
FIG. 1 is a perspective view of the assembled soccer goal frame of the present invention showing the connected members and the section and screw placement in such members.

Referring now to the drawings and particularly to FIG. 1A, a soccer goal frame shown generally as 20 is made up of two vertical side supports 22, a top horizontal member 24 having ends 21, 23, and two rearward bracing members 26 each connecting with one vertical side support member upper and lower ends 28, 30. A horizontal ground member 32 having first and second ends 34, 36 connects with rearward bracing members, shown generally as 26. Each rearward bracing member includes a central segment 43, a lower end 40 and an upper end 41. Junction 38 is formed by a connector 56 securing a vertical side support 22, one end of top horizontal member 24 and rearward bracing member upper end 41.

Figure 5:
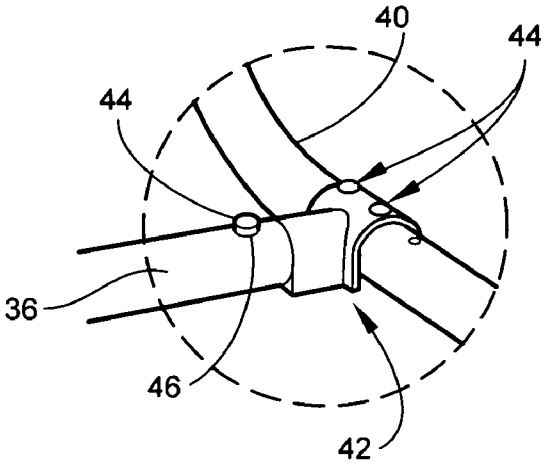
FIG. 5 is a perspective and enlarged view of the connection of one end of the horizontal ground member to the bracing member lower end.
Figure 6A:
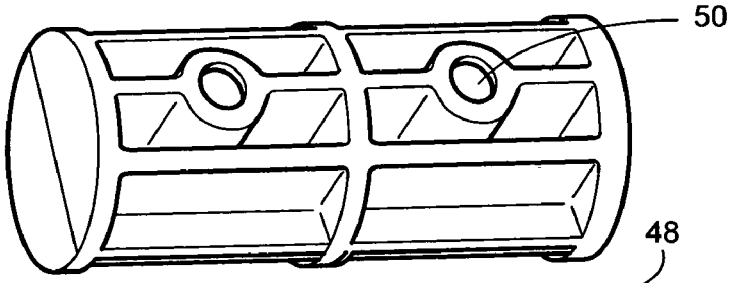
FIG. 6A is a top perspective view of a segment end-to-end joint connector for the smaller tubing.
Figure 7A:
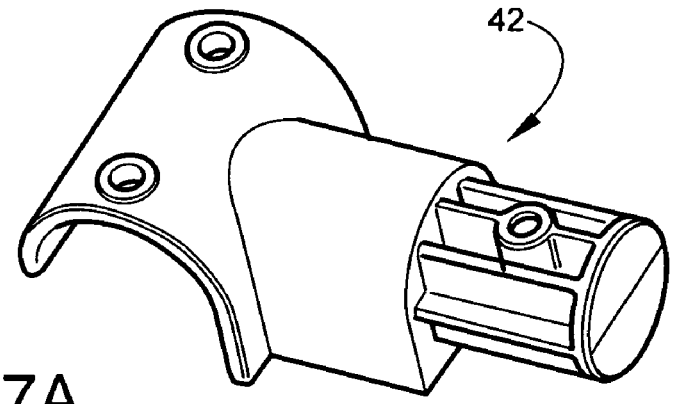
FIG. 7A is a top perspective view of the connector for joining the lower horizontal member to the lower bracing member section as shown in FIG. 5.
Figure 7B:
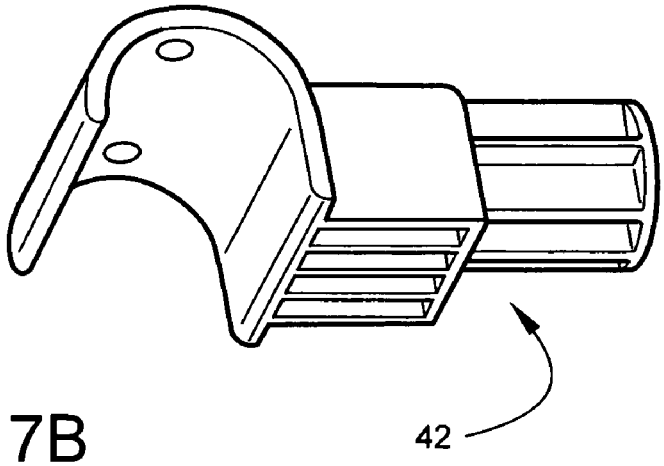
FIG. 7B is a bottom perspective view of the connector shown in FIG. 7A.
Figures 8A, 8B:
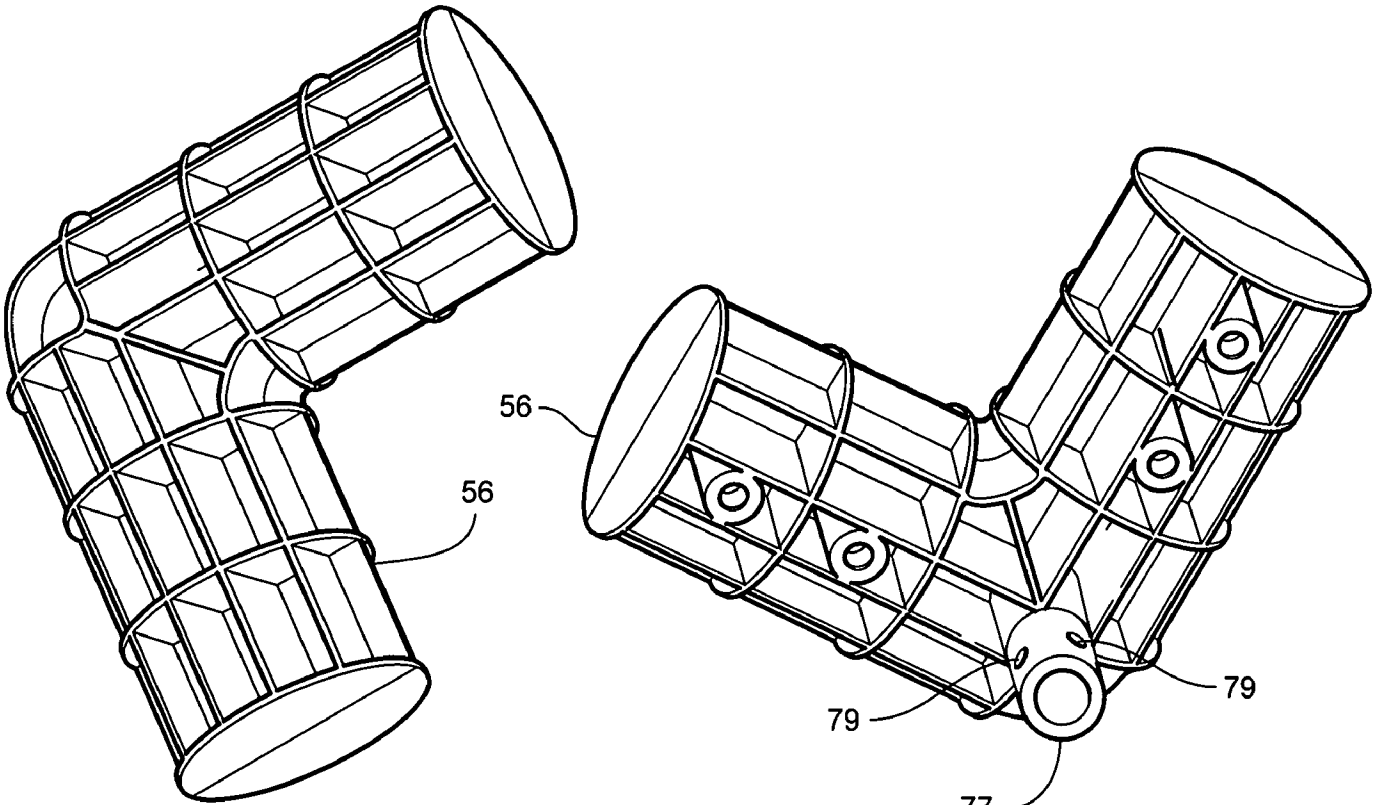
FIG. 8A is a top perspective view of the joint connector for connecting a vertical side support to the top horizontal member.
FIG. 8B is a bottom perspective view of the joint connector shown in FIG. 8A.

First end 34 of horizontal ground member 32 connects with rearward bracing member lower end 40 by means of a connector 42 as shown in FIGS. 7A and 7B. Securement of horizontal ground member 32 to bracing member lower end 40 (FIG. 5) is accomplished preferably by Allen screws 44 used with molded skewed washers 46 to provided appropriate tension. Connector 42 has mold formed apertures 50 which cooperatively receive screws as evident from FIG. 6A.

Variations in the size of goal frame 20 is usually accomplished by replacing vertical side supports 22, top horizontal member 24 and horizontal ground member 32 with longer or shorter sizes depending on the age grouping and size of the players or other circumstances. When changing sizes of rearward bracing members 26, only central segment 43 of that member need be replaced since lower end 40 and upper end 41, because of their arcuate configuration can remain as is. It is to be understood that additional lengths or reductions of all members can be achieved by adding or removing segments of each member until the desired length is attained.

Figure 6B:
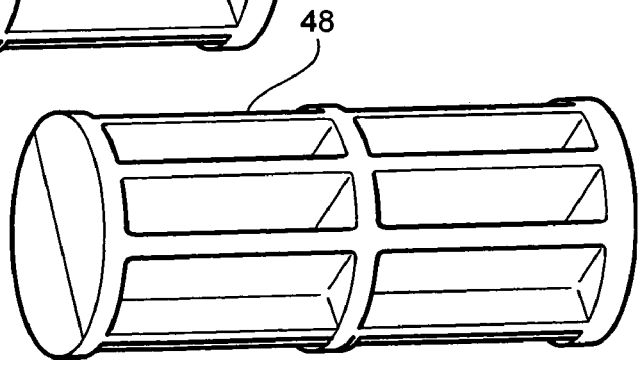
FIG. 6B is a lower perspective view of the connector shown in FIG. 6A.
Figure 6D:
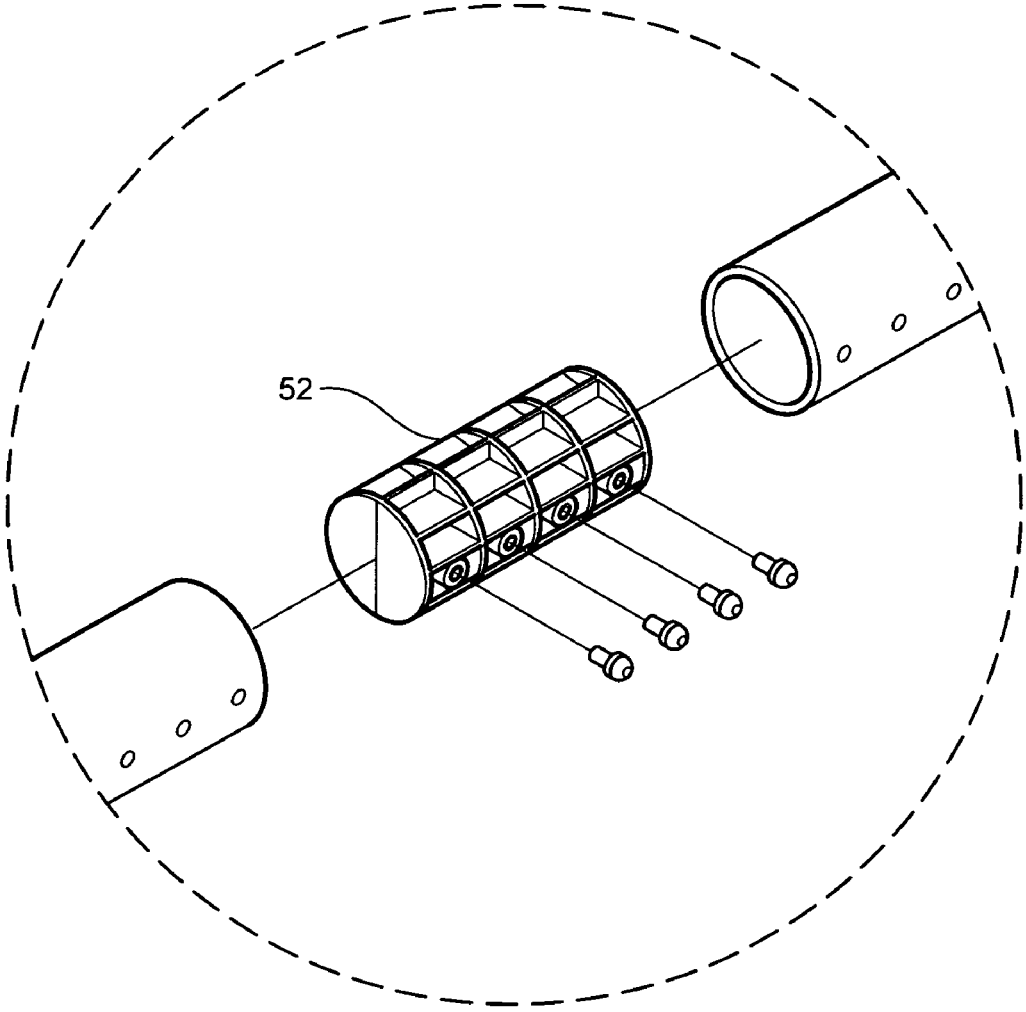
FIG. 6D is a perspective and exploded view of the connector joining two segments to form the top horizontal member.
Figure 12A:
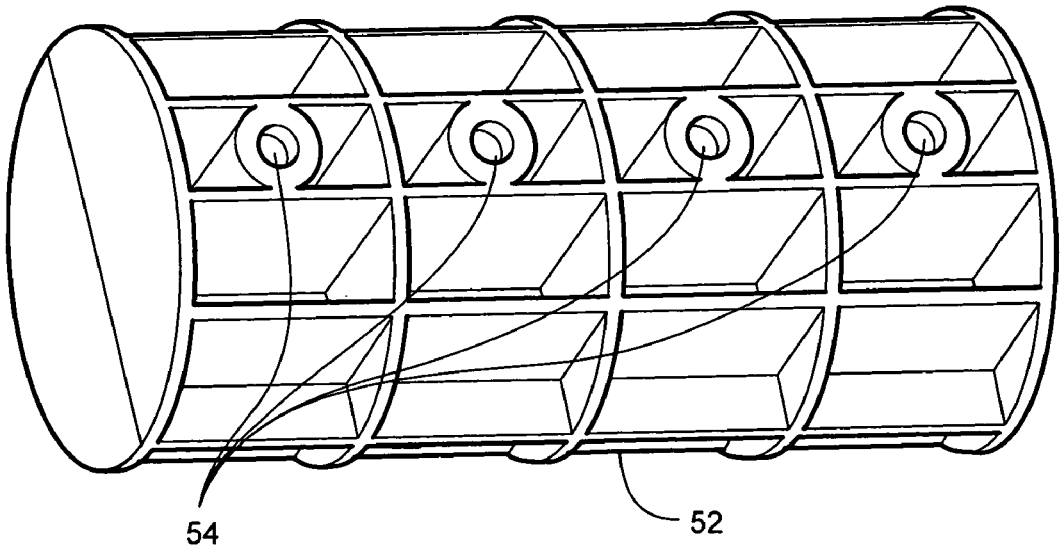
FIG. 12A is a top perspective view of the segment end-to-end joint connector for the larger tubing used to formed a connected condition in FIGS. 6C and 6D.
Figure 12B:
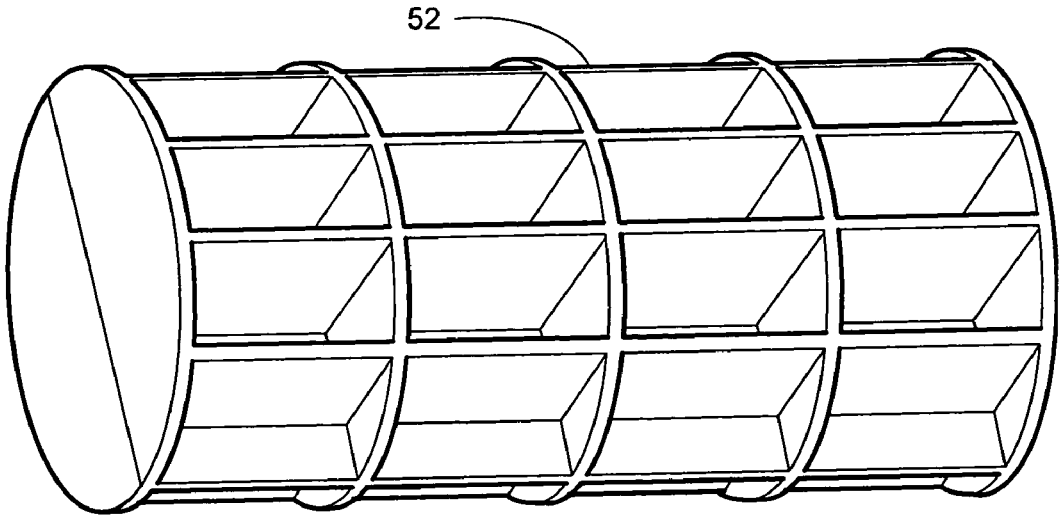
FIG. 12B is a bottom perspective view of the connector shown in FIG. 12A.

When any member, for example, rearward bracing member 26, is formed by a plurality of segments such as bracing member central segment 43 is connected with bracing member upper and lower ends 40, 41, the connection between each segment is made by the use of connector 48 shown in FIGS. 6A and 6B. Connector 48 extends into the hollow interior of segments 43 and 40 and 43 and 41, and mold formed apertures 50 cooperatively receive screws 44 extending through the tubular segment wall to firmly connect the segments to each other. If the connection involves the larger size members 22, 24 when these members are to be lengthened, connectors 52 as shown in FIGS. 12A and 12B are used. They join the added sections to the existing member in the same manner as described previously about joining segments of the smaller size tubing except that two or more additional apertures 54 are provided to receive additional screws because of the larger size of the segments.

Figures 2, 3, 4A, 4B:
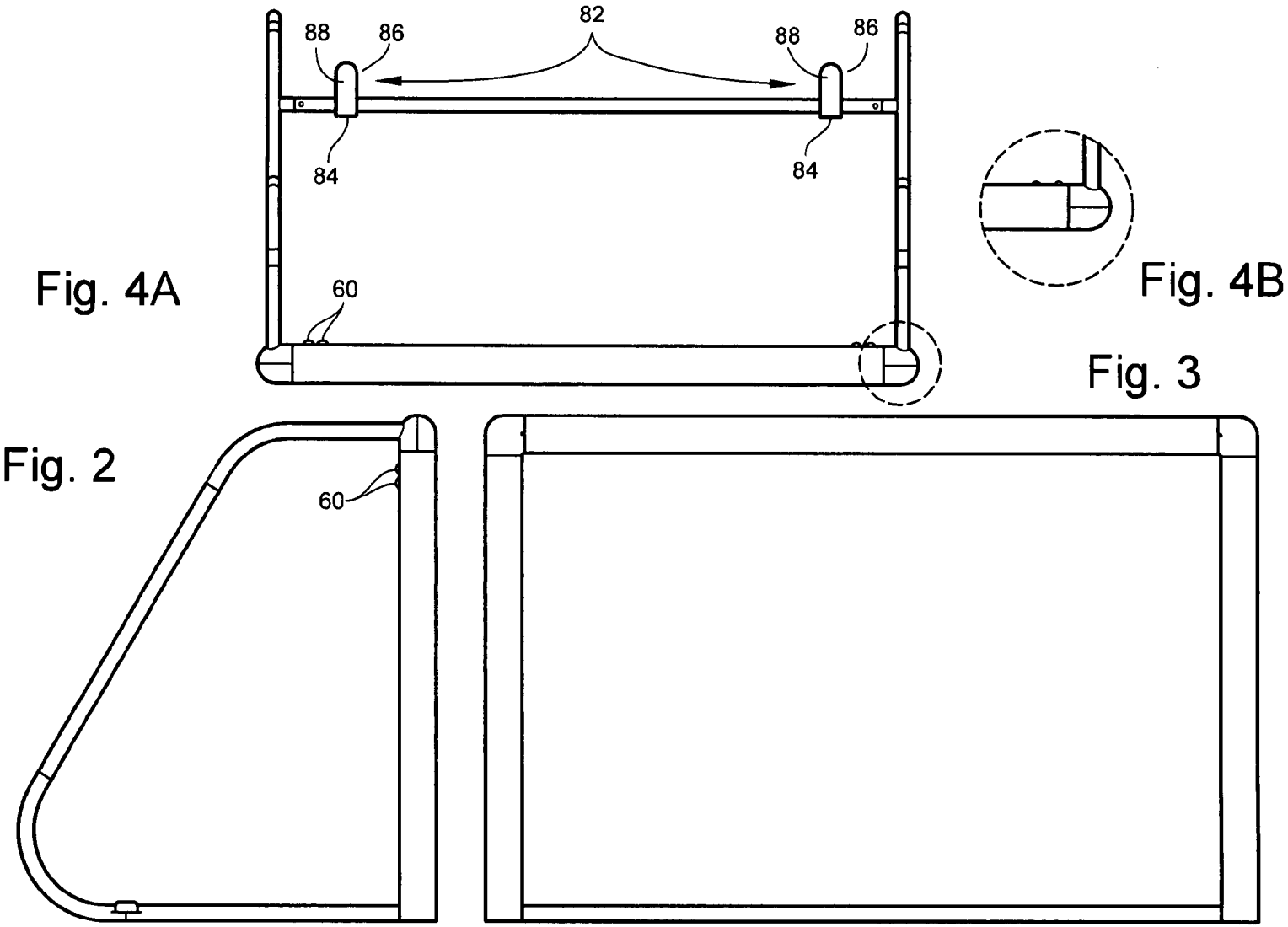
FIG. 2 is a side elevational view of the goal frame shown in FIG. 1A.
FIG. 3 is a front elevational view of the goal frame shown in FIG. 1A.
FIG. 4A is a plan view of the soccer goal frame shown in FIG. 1A.
FIG. 4B is an enlarged and isolated view of the connection of the top horizontal member, a vertical side support and a rearward bracing member.
Figure 9B:
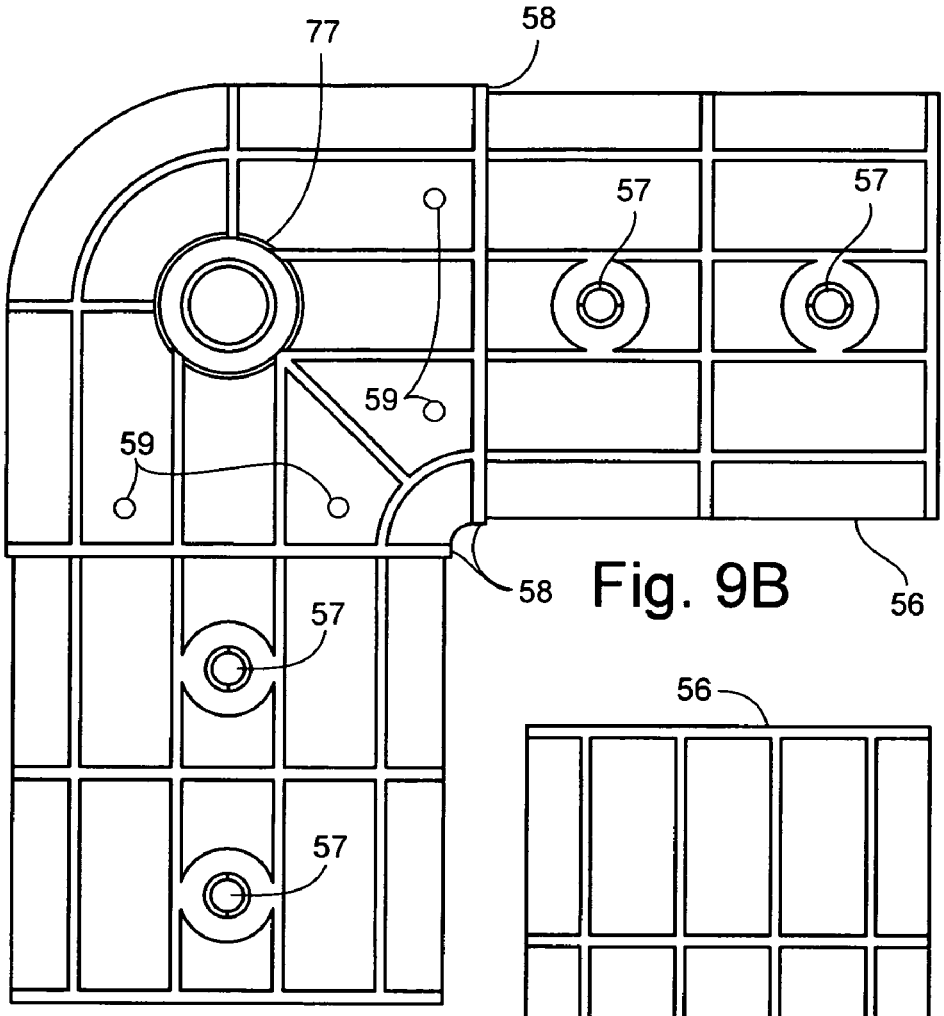
FIG. 9B is a rear elevational view of the connector shown in FIG. 8B.
Figure 9A:
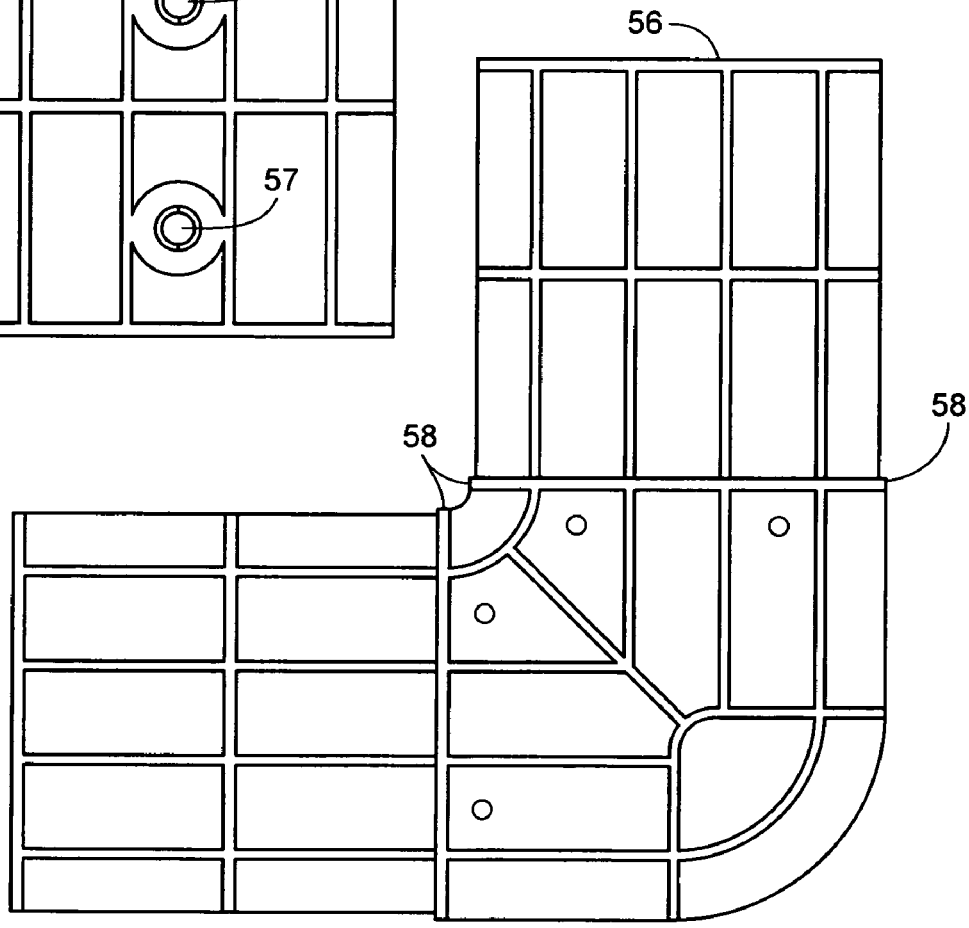
FIG. 9A is a front elevational view of the joint connector shown in FIG. 8A.
Figure 10A:
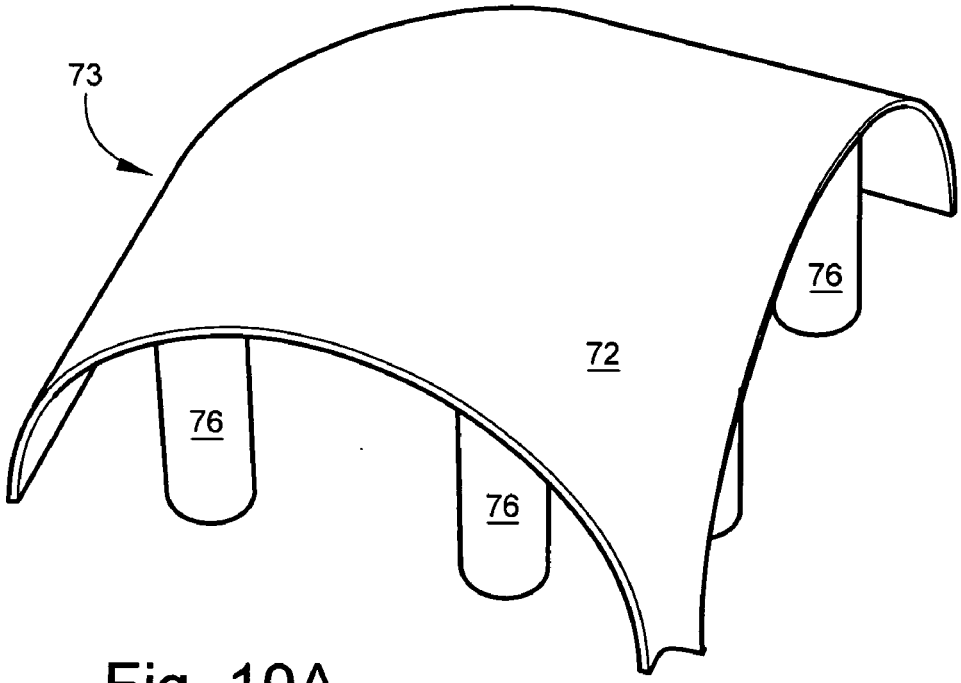
FIG. 10A is a top perspective view of the molded joint connector front cover shown in FIGS. 1A and 3.
Figure 10B:
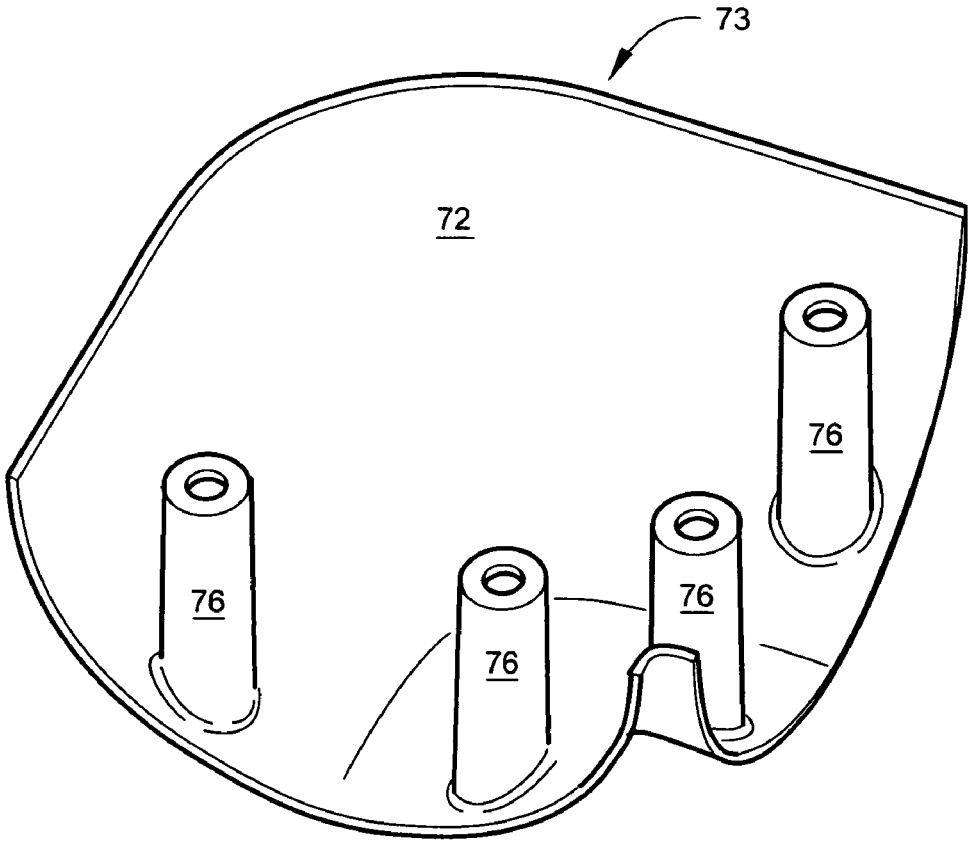
FIG. 10B is a bottom perspective view of the connector front cover shown in FIG. 10A.
Figure 11A:
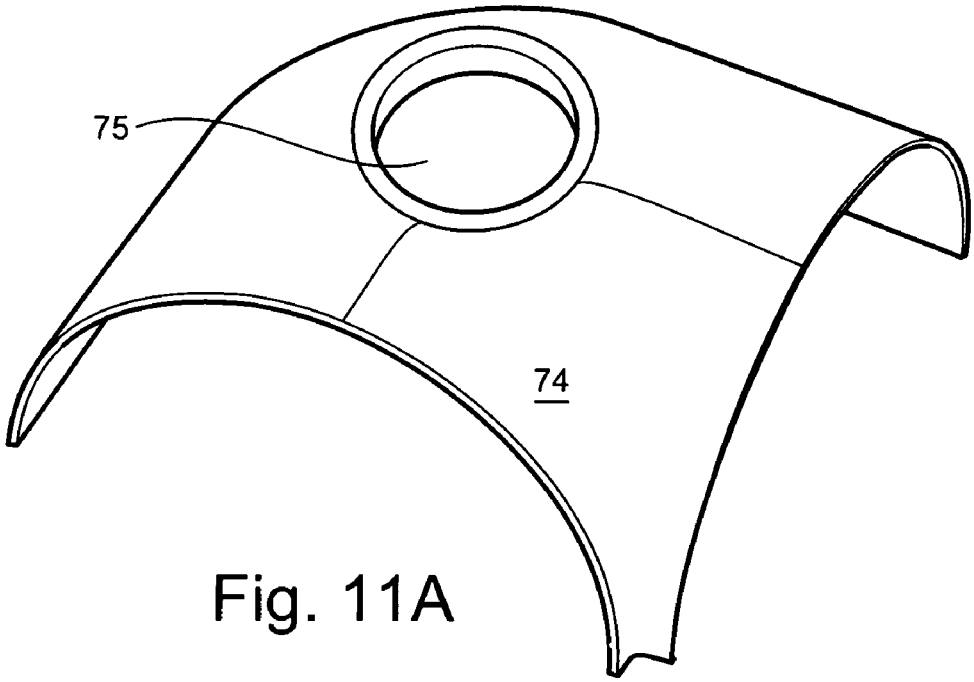
FIG. 11A is a top perspective view of the molded joint connector rear cover shown in FIGS. 2–4A.
Figure 11B:
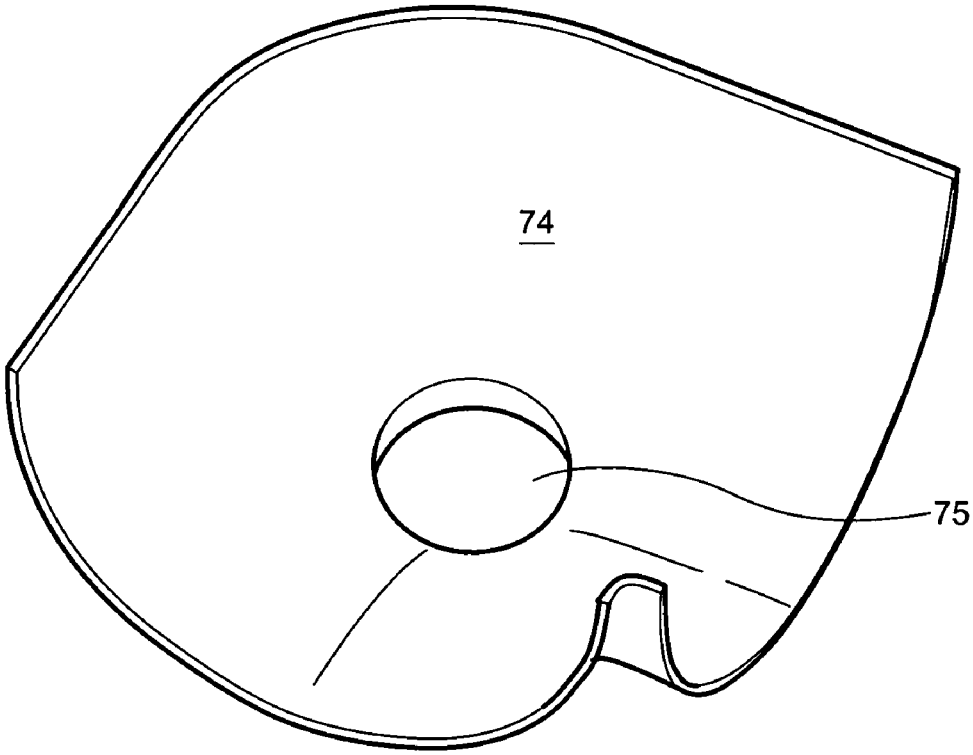
FIG. 11B is a bottom perspective view of the rear cover for the joint connector shown in FIGS. 2–4A.
Figure 15A:
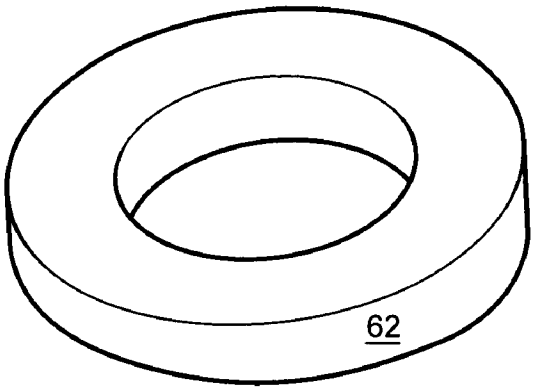
FIG. 15A is a top perspective view of the molded offset washer positioned between the securing screw and the connector molded recesses for the larger tubing.
Figure 15B:
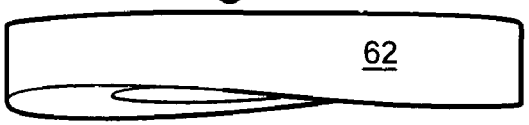
FIG. 15B is a side elevational view of the washer shown in FIG. 15A.

The connection of vertical side supports 22 to top horizontal member 24 is shown by referring to FIGS. 9A and 9B. These connectors 56 extend into the hollow interiors of members 22, 24 until ridge 58 engages the end of each member 22, 24. Connector 56 and connected members 22, 24 are secured by screws 60 as shown in FIGS. 2 and 4A which are cooperatively received by molded apertures 57. In this arrangement larger molded skewed washers 62 as shown in FIGS. 15A and 15B are used as tensioning devices to assure tight connections.

Connector 56, the ends 28 of vertical side supports 22 and the ends of top horizontal member 24 are housed within a cover 73 made up of a forward portion 72 and a rearward portion 74. Forward portion 72 has extended molded apertures 76 which project through the interior of connector 56. Screws pass through to apertures 59 mold formed within connector 56 to secure forward portion 72 over and against the forward side of connector 56. Rearward cover portion 74 has a mold formed opening 75, and the rearward side of connector 56 has a protrusion 77 extending in the rearward side direction. When assembled, protrusion 77 extends through aperture 75 so that cover portion 77 can be urged in the forward direction to place it in proper position to accommodate rearward bracing member upper end 41 with apertures that align with apertures 79 in protrusion 77. Threaded insert members (not shown) are positioned within apertures 79 during the molding process forming connector 56, and screws are then inserted through the apertures in upper end 41 into the now-threaded apertures 79 to tighten the cap and hold rearward portion upper end 41 and protrusion 77 in place.

Figure 13C:
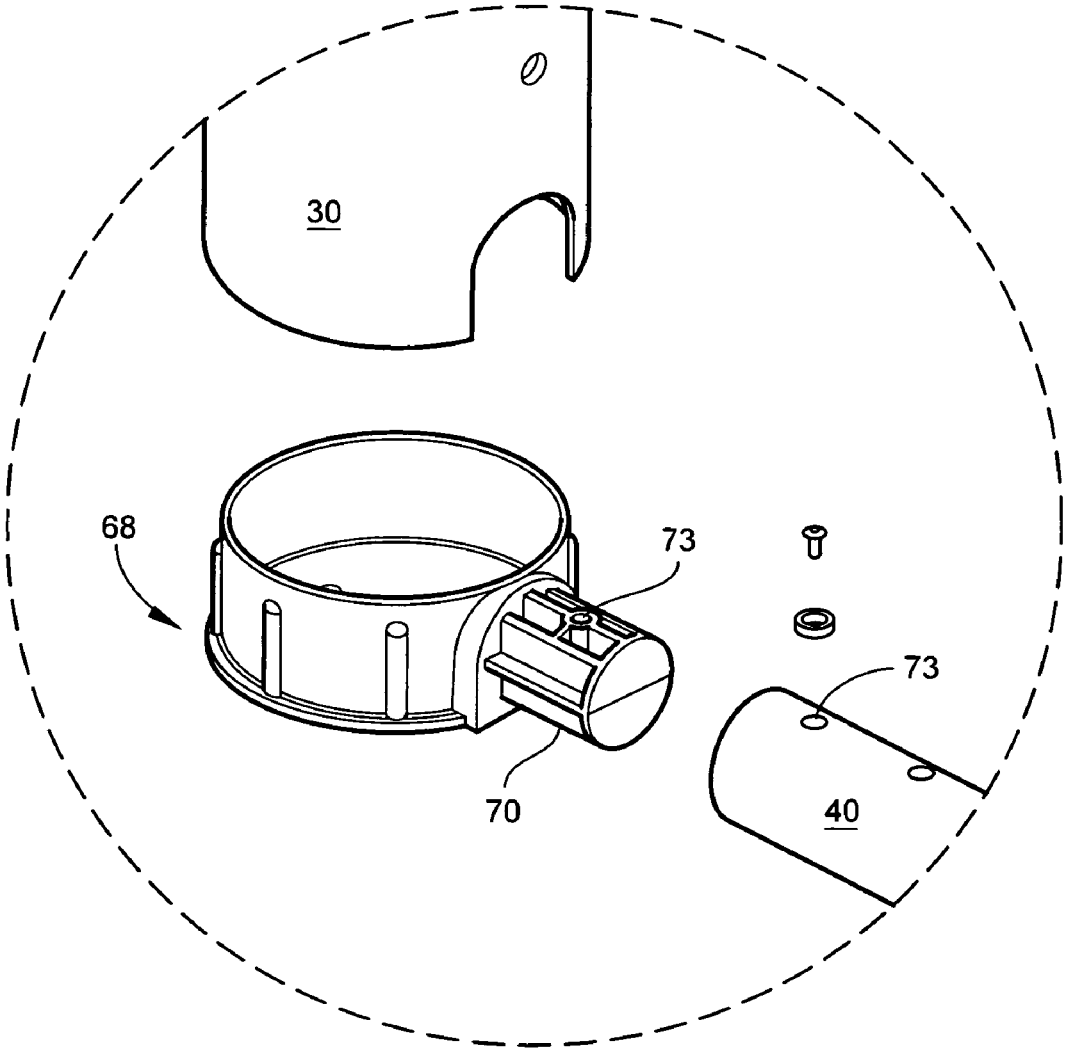
FIG. 13C is a perspective, exploded and enlarged view of the connector as shown in FIGS. 13A and 13B just before joining and securing the horizontal ground member to a vertical side support.
Figure 13D:
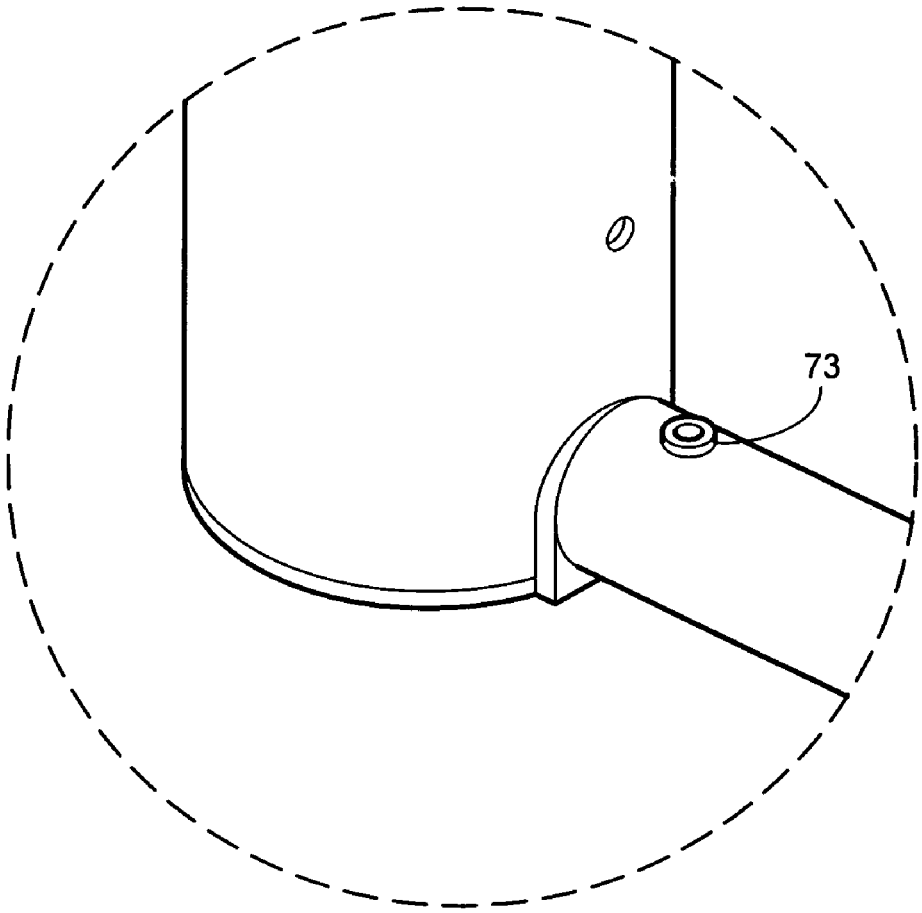
FIG. 13D is a perspective view of the elements shown in FIG. 13 in the joined condition.
Figure 14A:
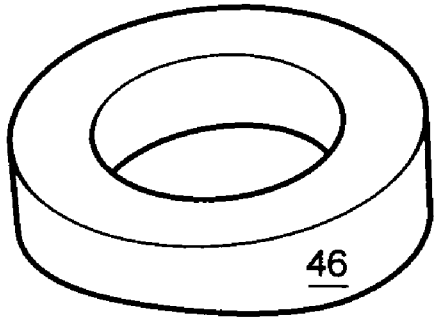
FIG. 14A is a top perspective view of the molded offset washer positioned between the securing screw and the connector molded recesses for the smaller tubing.
Figure 14B:
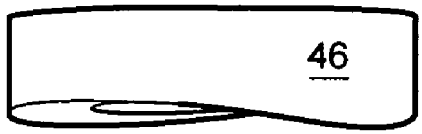
FIG. 14B is a side elevational view of the washer shown in FIG. 14A.

The connection of the lower ends 30 of vertical side supports 22 with rearward bracing portion lower end 40 is made with the use of connectors 68 shown in FIGS. 13A, 13B and 13C. Connector 68 has a projecting portion 70 which extends into the hollow interior of lower end 40, and a foot portion 71*a* is cooperatively received within the hollow interior of vertical side support lower end 30. Screws firmly connect connector projecting portion 70 through aperture 73 with lower end 40, and foot portion 71*a* is secured to member lower end 30 by frictional engagement between ridges 71*b* against the inside walls of member second end 30.

Figure 16A:
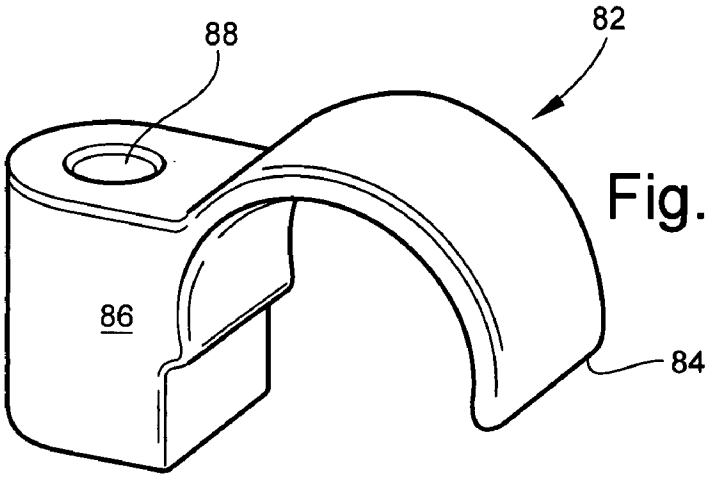
FIG. 16A is a top perspective view of the anchor to be secured to the lower horizontal member having an aperture formed therein to receive a pin or spike that will be embedded in the supporting surface for the goal frame.
Figure 16B:
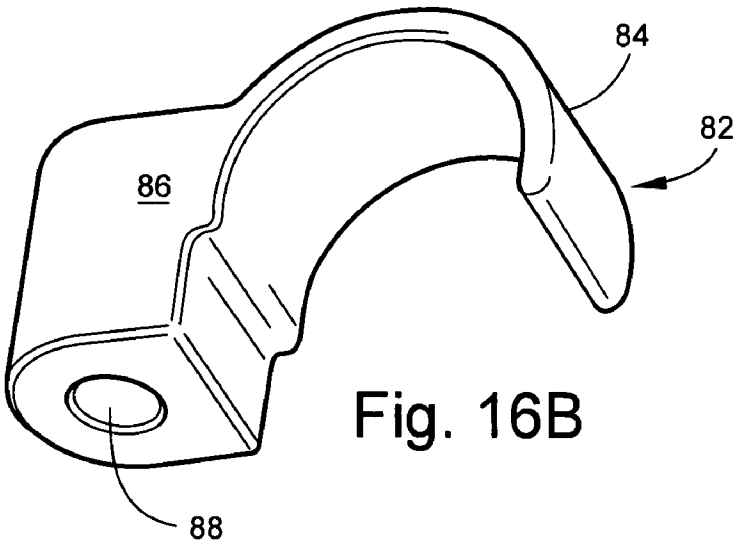
FIG. 16B is a bottom perspective view of the anchor shown in FIG. 16A.
Figure 16C:
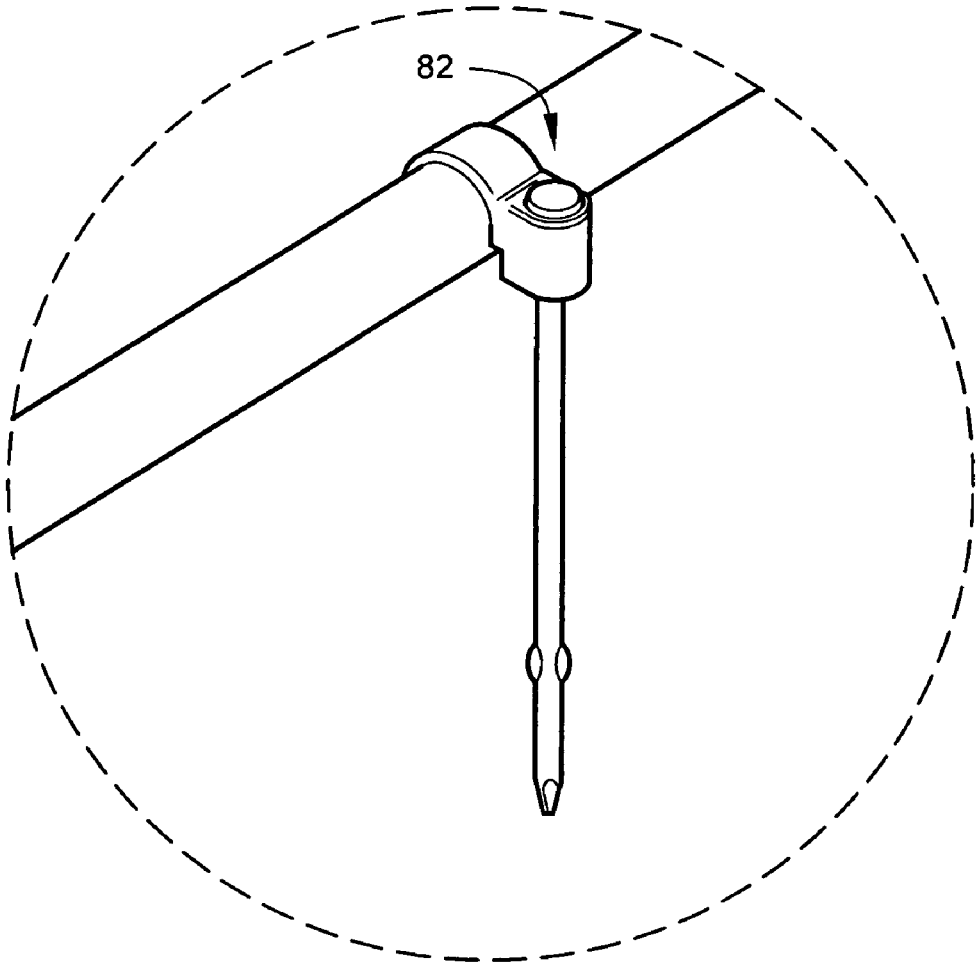
FIG. 16C is a perspective and enlarged view of the anchor and the received pin or spike.

Goal frame 20 is secured to its supporting surface 80 by a number of anchors generally designated 82 as shown in FIGS. 16A, 16B and 16C. Each anchor 82 has a flange portion 84 engaging lower horizontal member 32 circumferentially along its periphery and a surface engaging end 86 with an aperture 88 formed therein to receive a stake or spike (FIG. 16C) which passes through aperture 88 and into supporting surface 80 to secure frame 20 against movement.

From the preceding description, it can be seen that an adjustable and portable soccer goal frame and associated novel molded connectors have been provided that will meet all of the advantages of prior art devices and offer additional advantages not heretofore achievable. With respect to the foregoing invention, the optimum relationship to the parts of the invention including variations in size, materials, shape, form, function and manner of operation, use and assembly are deemed readily apparent to those skilled in the art. All equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the amended claims are deemed within the present inventive concept.

What is claimed is:

1. In a soccer goal having two tubular vertical support members each having upper and lower ends, a top tubular horizontal member having first and second ends joining the two vertical members, two tubular rearward bracing members with first and second ends, the first end connecting with the upper end of one of the vertical support members and one of the top horizontal member ends, and a tubular lower horizontal member having first and second ends, the tubular members all having tubular walls and clear interiors, a molded joint connector joining tubular members in a fixed and planned relationship comprising: a molded connector body portion configured to be cooperatively received by and secured to one vertical support member upper end and one top horizontal member end wherein a connector cover means encloses the molded connector body portion.

2. In a soccer goal having two tubular vertical support members each having upper and lower ends, a top tubular horizontal member having first and second ends joining the two vertical members, two tubular rearward bracing members with first and second ends, the first end connecting with the upper end of one of the vertical support members and one of the top horizontal member ends, and a tubular lower horizontal member having first and second ends, the tubular members all having tubular walls and clear interiors, a molded joint connector joining tubular members in a fixed and planned relationship comprising: a molded connector body portion configured to be cooperatively received by and secured to one vertical support member upper end and one top horizontal member end wherein a connector cover means encloses the molded connector body portion and the cover means includes a cover having a forward and rearward portion, the securing means includes mold formed receiving apertures in the connector body and fastening means extending through the one vertical support member end wall and through the one horizontal support member end wall and into at least one mold formed aperture in each connector body portion end.

3. In a soccer goal having two tubular vertical support members each having upper and lower ends, a top tubular horizontal member having first and second ends joining the two vertical members, two tubular rearward bracing members with first and second ends, the first end connecting with the upper end of one of the vertical support members and one of the top horizontal member ends, and a tubular lower horizontal member having first and second ends, the tubular members all having tubular walls and clear interiors, a molded joint connector joining tubular members in a fixed and planned relationship comprising: a molded connector body portion configured to be cooperatively received by and secured to one vertical support member upper end and one top horizontal member end wherein the connector body portion is formed at a right angle, and the cover top and bottom securing means includes mold formed apertures in the connector body and fastening means extending through the one vertical support member and through the one horizontal member end and into at least one mold formed aperture in each connector body portion end.

4. In a soccer goal having two tubular vertical members each having upper and lower ends, a top tubular horizontal member having first and second ends joining the two vertical members, two tubular rearward bracing members with first and second ends, the first end connecting the upper end of one of the vertical support members and one of the top horizontal member ends, and a tubular lower horizontal member having first and second ends, a molded joint connector joing tubular members in a fixed and planned relationship comprising: a molded connector body portion connecting to a tubular rearward bracing member second end; a body extension member extending from the connector body portion and having an extended end configured to be cooperatively received by and secured to one lower horizontal member end; and means securing the connector body portion to one lower horizontal member end wherein the connector body portion has an arcuate flange engaging a portion of a lower horizontal member end circumference.

* * * * *